US011878228B2

(12) United States Patent
Edwards

(10) Patent No.: US 11,878,228 B2
(45) Date of Patent: Jan. 23, 2024

(54) FOLLOW THROUGH FIXER

(71) Applicant: Travis Preston Edwards, Austin, TX (US)

(72) Inventor: Travis Preston Edwards, Austin, TX (US)

(73) Assignee: Travis Preston Edwards, Austin, TX (US)

( * ) Notice: Subject to any disclaimer, the term of this patent is extended or adjusted under 35 U.S.C. 154(b) by 144 days.

(21) Appl. No.: 17/486,897

(22) Filed: Sep. 27, 2021

(65) Prior Publication Data

US 2022/0118333 A1 Apr. 21, 2022

Related U.S. Application Data

(60) Provisional application No. 63/094,266, filed on Oct. 20, 2020.

(51) Int. Cl.
*A63B 69/00* (2006.01)

(52) U.S. Cl.
CPC ..... *A63B 69/0059* (2013.01); *A63B 69/0071* (2013.01); *A63B 2209/10* (2013.01)

(58) Field of Classification Search
CPC ..... A63B 69/0059; A63B 69/0071
USPC ..... 473/450
See application file for complete search history.

(56) References Cited

U.S. PATENT DOCUMENTS

| | | | | |
|---|---|---|---|---|
| 732,532 | A * | 6/1903 | Fallek | A44C 9/00 473/61 |
| 2,271,164 | A * | 1/1942 | Sullivan | A63B 23/16 482/47 |
| 3,189,025 | A * | 6/1965 | Yaklin | A61F 5/10 601/40 |
| 3,640,532 | A * | 2/1972 | Bauer | A63B 69/0071 473/450 |
| 3,880,426 | A * | 4/1975 | Morse | A63D 5/00 473/61 |
| 5,135,217 | A * | 8/1992 | Swain | A63B 69/0071 473/450 |
| 6,095,936 | A | 8/2000 | Kirkpatrick | |
| 6,729,979 | B1 * | 5/2004 | Sullivan | A63B 69/0071 473/450 |
| 7,288,051 | B1 * | 10/2007 | Phillips | A63B 21/4039 482/45 |
| 7,442,133 | B2 | 10/2008 | Wolf | |
| 8,162,781 | B2 * | 4/2012 | Heflin, Sr. | A63B 69/0059 473/448 |
| 10,434,393 | B2 * | 10/2019 | Young | A63B 69/0071 |
| 2003/0069094 | A1 | 11/2003 | Sheppard | |
| 2009/0318248 | A1 | 12/2009 | Russotti | |
| 2012/0283049 | A1 | 11/2012 | Grover | |
| 2015/0202514 | A1 * | 7/2015 | Ervin | A63B 69/0059 473/450 |
| 2022/0118333 | A1 * | 4/2022 | Edwards | A63B 69/0071 473/450 |

* cited by examiner

*Primary Examiner* — Mitra Aryanpour

(57) ABSTRACT

The Follow Through Fixer is a basketball shooting aid that is worn on a basketball player's shooting arm. It helps a player straighten their follow through, correct their finger spacing, and quicken their release time. The present invention also comes with a unique assembly and design that allows for a player to take the device on and off easily, allowing them to seamlessly transition from practicing with the shooting aid to playing without it.

18 Claims, 4 Drawing Sheets

FOLLOW THROUGH FIXER

Figure 1:
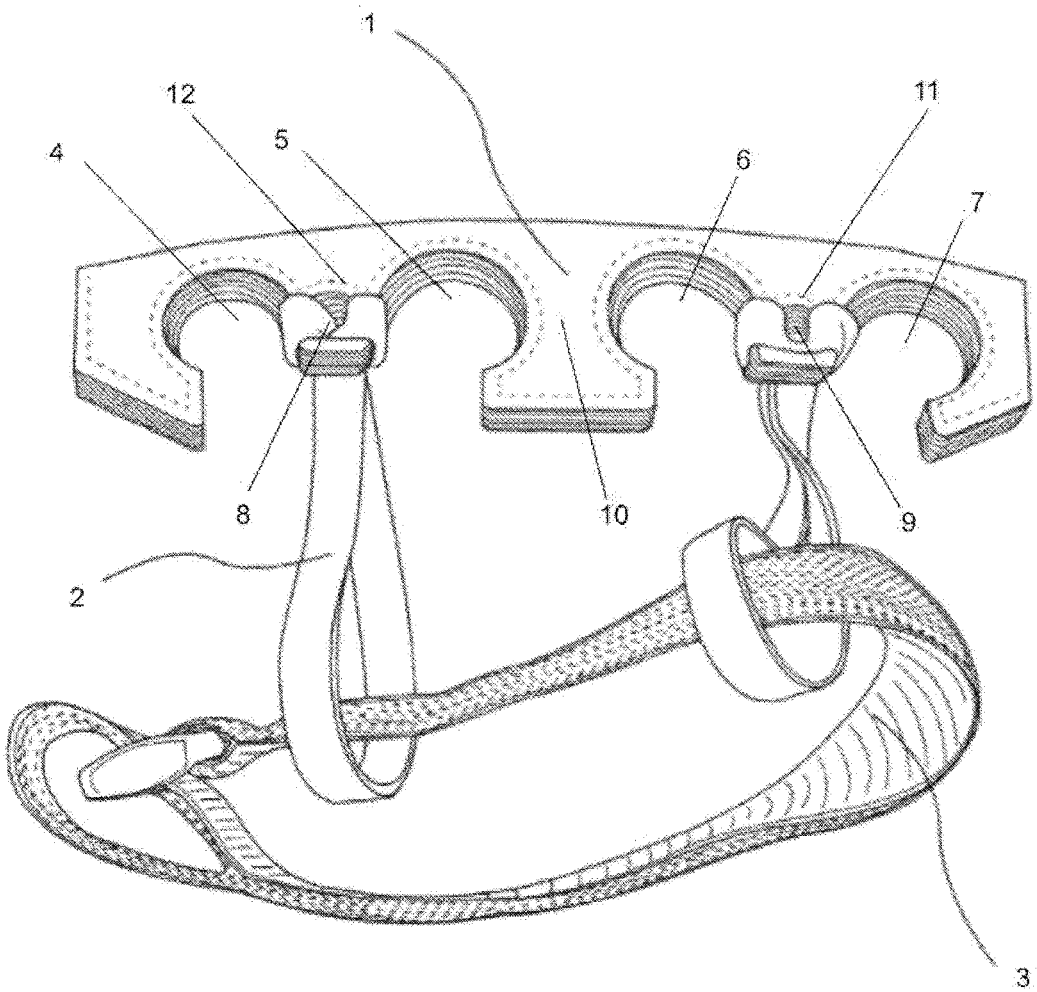

FIELD OF INVENTION the present invention relates to sport equipment, more specifically a basketball shooting aid that is worn on a basketball player's shooting arm.

BACKGROUND OF INVENTION

Shooting is an essential skill for basketball. The fundamental skills of passing, dribbling, defense, and rebounding are all important aspects of basketball, but you must be able to make shots to score points. A large part of shooting is mental attitude. In addition to shooting skill, confidence is necessary to shoot well. The combination of mental attitude and mechanical skill fosters shooting success. If a basketball player has an accurate shot, the defender is forced to play you tight in order to contest your shot. Playing defense tight and aggressive allows the offensive player to perform a successful fake, opening options to pass, drive, or shoot. If a player cannot shoot accurately, a defender does not need to play tight defense and can go back, anticipating a drive or pass by the offensive player. Therefore the defender would be less susceptible to the offensive players' fake. When you do not have the ball, your defender can play farther off you and be in a better position to give defensive help to a teammate guarding another player. To be successful, a team must have players who can make the outside shot to keep the defense honest.

The best shooters can be referred to as pure shooters because they have a smooth, natural, free flowing shot. Great shooters are not born with this ability, but rather work many years to develop their technique. Players, such as Stephen Curry, can dribble at full speed around a defender then effortlessly put up an accurate shot. The best shooters place pressure on their defender to play them tight, which allows them the opportunity to drive, pass, or shoot, or try a fake. For Stephen Curry and other great shooters, the skill is automatic. They execute their skills at the highest level without conscious thought. Each was a beginner at one time, however, each developed into a skilled shooter through dedicated practice. Shooting is a skill you can practice independently. Once you understand correct mechanics, all you need is a ball, a basket, and a desire to improve.

According to Dr. Gintaras Duda, the physics professor at Creighton University, for a player to have a chance of making a three point shot, the ball must be released at least 33 degrees from their hand for a slight chance to hit a shot. However, a release of 45 degrees pushing the ball at almost and rotating twice every second from the 3-point line distance of 20.9 feet away from the basket will provide the best chance of converting a 3-point shot. This finding suggests that shooting an accurate basketball shot is very much dependent on the angle of release of the shot.

The present invention is a basketball shooting aid that is worn on a basketball player's shooting arm. It helps a player straighten their follow through, correct their finger spacing, and quicken their shot release time. It helps a player release the ball and ensures that the wrist and fingers of the shooting hand fall down in a straight line, which is ideal for shooting a basketball.

DESCRIPTION OF PRIOR ARTS

U.S. Pat. No. 5,135,217A a training device for developing proper shooting techniques for basketball players in which the wrist is held in the proper cocked position prior to shooting and returned to that position subsequent to shooting through the use of a yieldable tensioning member secured between the upper arm and hand of the players by an arm connector and hand connector.

U.S. Pat. No. 6,095,936A a shooting aid for basketball players designed to keep the elbow of the shooting arm in towards the centerline of the body during shooting. The shooting aid is comprised of a sleeve adapted to fit around the shooting arm of the basketball player; a clip adapted to be secured to clothing worn by the basketball player; and an elastomeric cord with two ends having one end attached to the sleeve and the other end attached to the clip, wherein the cord is of sufficient length to restrain the position of the player's shooting arm when the player shoots a basketball. In another embodiment, a belt adapted to be worn by the player can be used instead of the clip.

U.S. Pat. No. 7,442,133B2 a shooting and training aid for basketball players to prevent interference of the non-shooting hand when shooting a basketball. This interference is caused by the non-shooting hand unnecessarily providing force for the shot as well as the fingers on the non-shooting hand dragging on the side of the ball. The shooting and training aid is provided with several adjustable members which ultimately would wind around the arms of the non-shooting hand, include a loop attached to the base of the thumb of the non-shooting hand as well as a pocket member into which at least the tip of the middle finger of the non-shooting hand is inserted.

US20120283049A1 the disclosure relates to a device for training proper finger spacing on a basketball ball at the time of releasing the ball. The basketball training devices provided herein maintain two adjacent fingers in comfortably spaced relation to enable the player to support and release the ball from those two fingers, thereby increasing the player's control of the ball and improving the accuracy of the basketball shot. A method for maintaining two adjacent fingers of a basketball player's hand in spaced and angled relation when shooting a basketball is provided. A method for making the training device is also provided.

US20030069094A1 a basketball shot trainer for controlling the movement of the user's shooting arm in a predetermined direction and predetermined elbow placement. The shooter's arm is connected to an arm bar such that the shooting arm and elbow pivot in a predetermined manner relative to the user's torso. The shooting arm is held in the desired position on the user by means of a back plate which supports the arm bar for pivotal movement to control movement of the user's shooting arm. The arm bar has a guide portion which is secured to the user's shooting arm by an arm band which controls movement of the shooting arm in a predetermined vertical plane.

US20090318248A1 a basketball training aid designed to teach a user how to correctly grip, set up, and release a basketball. The device includes a material that wraps around the top (prone side) of the hand and bottom half of the underside (supine side) of the hand, without limiting wrist extension and flexion during a basketball shot. The glove includes a splint support material on top of the index, middle, and ring fingers, running from the middle of the digits to the bottom half of the top (prone side) of the hand. The splint support material prevents premature finger flexion at the base of the fingers during the release of the shot, ensuring an open hand at follow through. Additionally, the design encourages proper finger separation and proper extension of wrist joint on set up, keeps the ball off the palm of the hand, and promotes proper position for dribbling a basketball effectively.

There are many inventions in the market like the present invention, but they would only guide down the fingers and not the entire hand including the wrist. That would then allow a player to still have a wayward follow through as they could contort their wrist at strange angles. These similar inventions also fail to ensure fingers were spaced properly. The present invention was also designed to make sure that the elastomeric members would not go directly on the fingers, avoiding potential discomfort or pain as the elastomeric could tighten around the fingers when tension increased. The present invention also comes with a unique assembly and design that allows for a player to take the device on and off very easily, allowing them to seamlessly transition from practicing with it to playing without it.

SUMMARY OF THE INVENTION

The following summary discloses all the features and functions of the present invention. Reviewing the entire specifications, claims, drawings and abstract helps to provide a full understanding of the invention and its functions.

The Follow Through Fixer is a basketball shooting aid that is worn on a basketball player's shooting arm. It helps a player straighten their follow through, correct their finger spacing, and quicken their release time. An adjustable band is anchored to a player's forearm, which connects to a finger comb via two elastomeric members. It utilizes an adjustable band to connect the device to the forearm and a comb-shaped spacer which is worn on the fingers. There are two elastomeric members at the front of the device that are stretched when a shooter brings back his wrist and hand, tending to cause the player to bring their hand back forward. As the player shoots and releases the basketball, the elastomeric members will pull the finger comb down causing both the wrist and hand to fall down in a straight line. Having the elastomeric members guide the hand when a player releases the ball ensures that the wrist and fingers fall down in a straight line, which is ideal for shooting a basketball. The finger comb allows the fingers to stay in the correct position the entire time while shooting. The finger comb also provides the attachment point for the elastomeric members which provides the force to pull the fingers and hand down in a comfortable way. Additionally, the tension in the elastomeric members will cause the hand to be drawn forward quicker and therefore cause the ball to be released quicker. Thus, it quickens release time. The unique design of the finger comb of the Follow Through Fixer, was designed to ensure that the elastomeric members would not need to attach directly to the fingers as this could cause pain as the elastomerics could tighten around the fingers when tension increased. Also due to its unique design, the finger comb is open on the palm side of the hand which allows a player to take the device on and off quickly and easily, providing a seamless transition from practicing with the aid to playing without it.

BRIEF DESCRIPTIONS OF FIGURES

Figure 2:
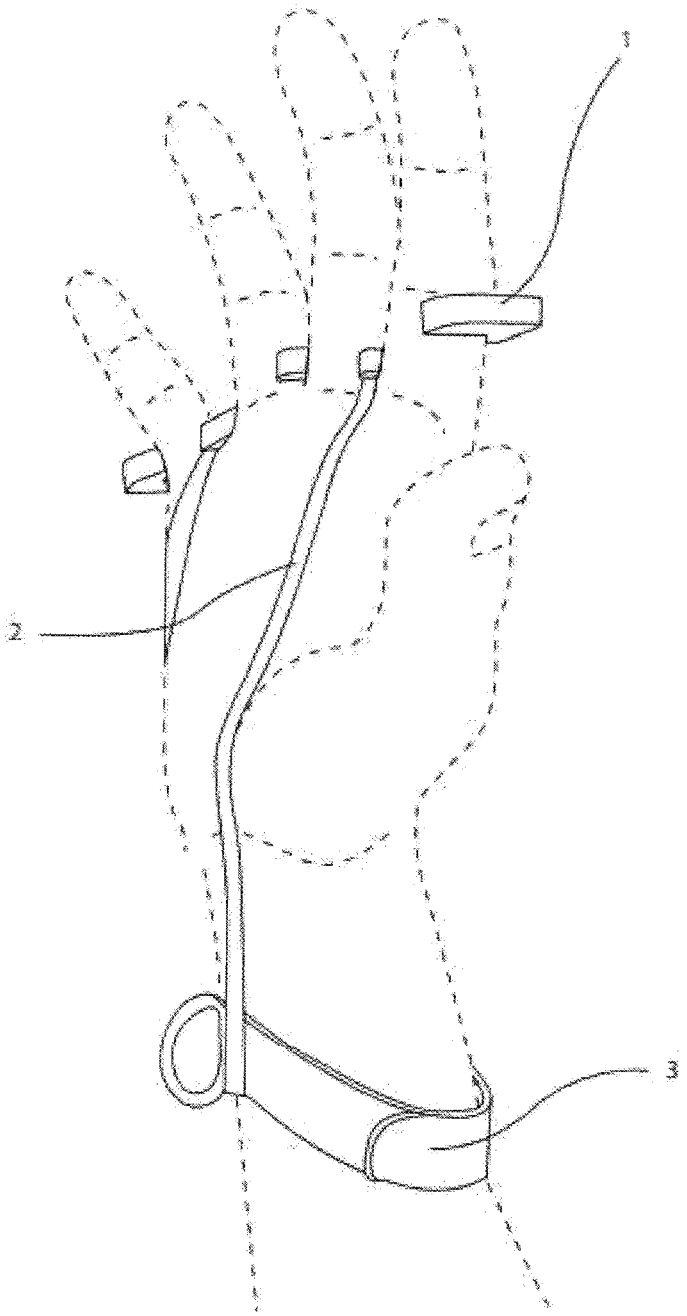
Figure 3:
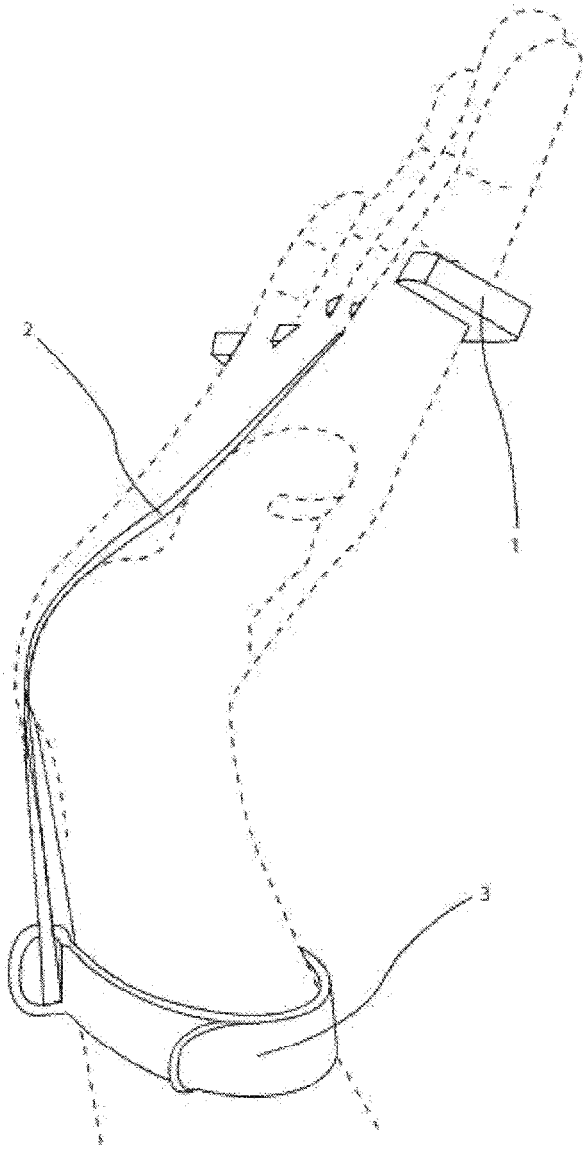
Figure 4:
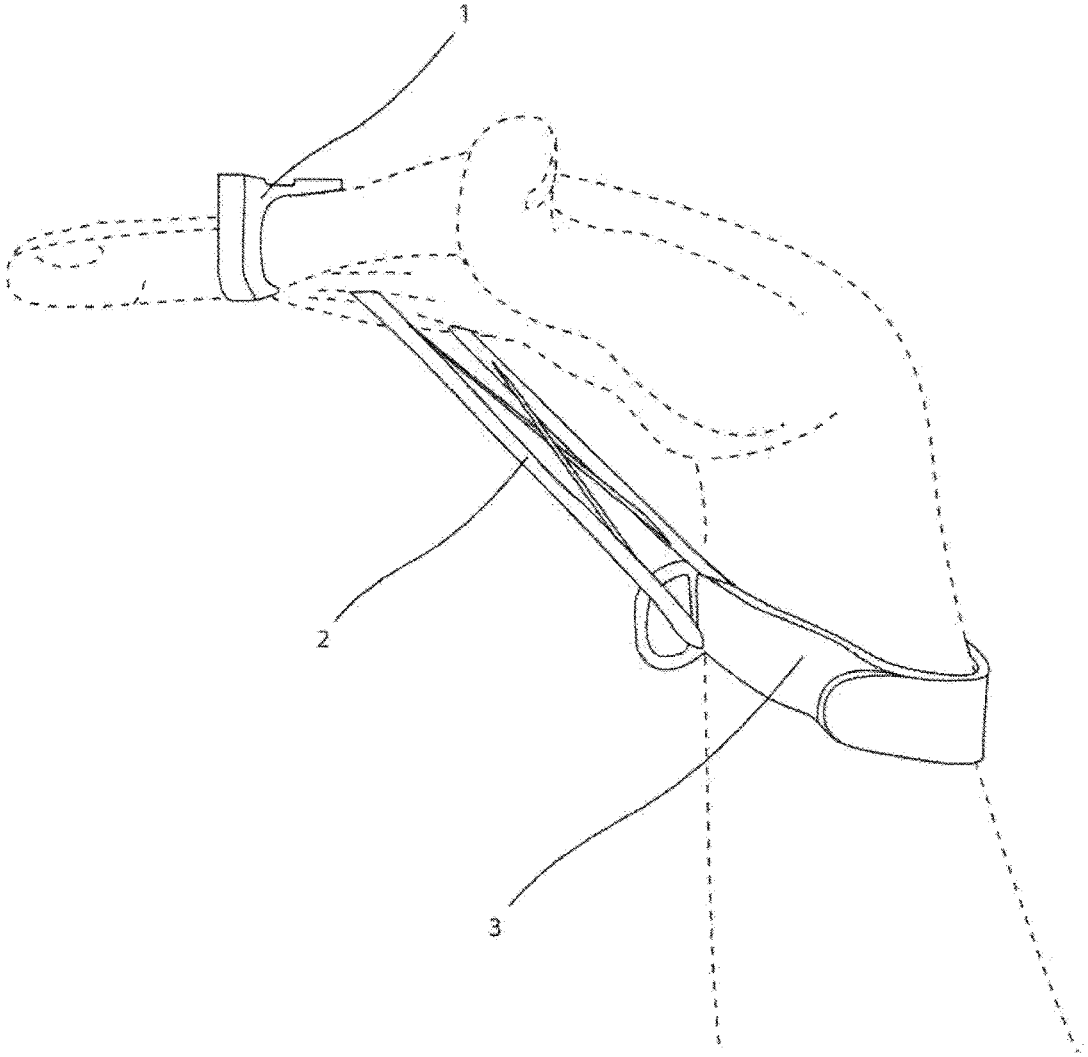

FIG. 1, is a perspective side view of the invention;
FIGS. 2,3, & 4, is an illustrative view of the invention.

DETAILED DESCRIPTION OF FIGURES

IN FIG. 1, a perspective view of the Follow Through Fixer is displayed, which is comprised of the finger comb (1), the elastomeric member (2), the forearm anchor (3), the finger holes (4-7), the connection holes (8-9), the primary finger spacer (10), and the secondary finger spacers (11-12).

A finger comb is a device worn such that it causes fingers to be spaced. It preferably has four holes for fingers (4-7), but it could have as few as two. The holes for the finger comb must be open as it allows for easy removal if a user desires to play without it. Open finger holes mean that the finger comb cannot encompass the entirety of the circumference of the fingers, but rather there must be a visible gap. The device should be preferably flexible, created out of a material like TPU (thermoplastic polyurethane), as it makes it easier to install the device on the shooter's fingers as well as increasing the comfort by contouring to the user's hand and fingers; however, it can be rigid and still serve its primary purpose. The finger comb is preferably flexible and not stretchy. It should bend to fit the user's knuckles more securely, but it should not be able to stretch and cause the size and spacing of finger holes to distort significantly. The device needs to be connected from finger to finger, in order to maintain the same spacing no matter the user's hand and wrist position. Ideally it should be worn between the middle knuckle and base knuckle; however, it could be worn higher in the hand and achieve the same goal of spacing the fingers. The size of the primary and secondary spacers would have to be larger the higher up the device is worn on the hand. The primary finger spacer separates the middle and ring fingers while the secondary finger spacers are what separates the index and middle fingers as well as separating the ring and pinky fingers. The finger holes are located inside the secondary finger spacers on the palm side of the hand. They are created in such a way that when connecting the elastomeric members, the elastomeric members go over the palm and the inside forearm, unencumbered by the finger spacer. The connection holes are on the front, palm side half of the finger comb, so the elastomeric members naturally rest on the palm side of the hand.

A forearm anchor is a wearable element on the user's arm that provides an anchor point on the user's forearm for the entirety of the device. The forearm anchor is a device that must have a means by which it can be attached and detached. Preferably, the forearm anchor is adjustable so it can conform to the specific size of a user's forearm. The adjustability can be achieved either by using an elastomeric material or by means of an adjustable strap such as a buckle or velcro. The forearm anchor should ideally be made of velcro as it is very easy to tighten or loosen. The Forearm Anchor preferably encircles the entirety of the circumference of the forearm in order to provide the most secure fit. It can encircle the forearm only partially; however, after testing, it is more secure to have the Forearm Anchor encircle the entirety of the arm. In preferred embodiments the forearm anchor is placed below or at the midpoint of the forearm. Depending on how much tension the user desires from the device, they can attach the Forearm Anchor in various places. If placed closer to the wrist, the Forearm Anchor would provide less tension, and if moved closer to the elbow, tension would increase.

The finger comb is connected to the forearm anchor via two elastomeric members (2). The two elastomeric members are looped through the connection holes in the finger comb (8,9). The forearm anchor is then threaded through the elastomeric members such that the forearm anchor is now connected to the elastomeric members and in turn is connected to the finger comb. The Primary Finger Spacer (10) is used to separate the middle and ring fingers. The thickness of the spacers could vary depending on where the finger comb is placed on the fingers. The size is also variable due to the fact that there are larger and smaller hands. The Secondary Finger Spacers (11-12) can also vary in size for the same reason.

IN FIG. 2, a partial front side view of the Follow Through Fixer is shown, which displays a relaxed upright position of the shooting hand of a player with the finger comb (1), the elastomeric member (2), and the forearm anchor (3), all in a relaxed position.

IN FIG. 3, a partial front side view of the Follow Through Fixer is displayed which further exhibits a shooting position of the fingers and wrist, with the finger comb (1), the elastomeric member (2), and forearm anchor (3) properly positioning the wrist and providing the adequate finger spacing for a proper shot.

IN FIG. 4, a side view of the Follow Through Fixer is displayed, which exhibits a bent position of the fingers and wrist, with the finger comb (1), the elastomeric member (2), and the forearm anchor (3) fitted.

The invention claimed is:

1. A device capable of adjusting motion of a-user's hand, said user's hand including a palm portion and fingers, the device comprising:

a. a finger comb having one or more finger holes, wherein the one or more finger holes are open-ended finger holes, said one or more finger holes partially encircling said user's one or more fingers;

b. a forearm anchor; and c. at least one elastomeric member connected at one end to the finger comb and connected at the other end to the forearm anchor and configured such that the elastomeric member extends across the user's palm portion.

2. The device of claim 1 wherein the forearm anchor is adjustable in order to accommodate different user arm sizes.

3. The device of claim 2 wherein the forearm anchor is manually adjusted to different sizes that are not dependent on the size of the user's forearm.

4. The device of claim 3 wherein the forearm anchor is consisting of at least one of a buckle and a strap.

5. The device of claim 1 in which the at least one elastomeric member is at least two elastomeric members.

6. The device of claim 5 wherein the at least two elastomeric member is releasably connected to the finger comb.

7. The device of claim 5 in which the at least two elastomeric members are releasably connected to the forearm anchor.

8. The device of claim 1 wherein the at least one elastomeric member extend over the user's palm portion and inside forearm.

9. The device of claim 1 wherein the finger comb is capable of being removed from the user's fingers independent of the forearm anchor.

10. The device of claim 1 wherein the at least one elastomeric member is stretched when the user's hand moves backwards.

11. The device of claim 1 wherein the at least one elastomeric member does not directly attach to the user's fingers.

12. The device of claim 1 wherein the finger comb is capable of being threaded onto a user's fingers.

13. The device of claim 1 wherein the user's fingers are isolated by spacing.

14. The device of claim 1 wherein the forearm anchor surrounds the entirety of the circumference of a user's forearm.

15. The device of claim 1 wherein the at least one elastomeric member is independent of the finger comb.

16. The device of claim 15 wherein the at least one elastomeric member is at least two elastic members which are independent of each other.

17. The device of claim 1 wherein the finger comb is bendable.

18. The device of claim 1 wherein the finger comb, is releasably connected to a user's fingers, and is releasably connected to the at least one elastomeric member, which extend down the user's palm and inside forearm and is releasably connected to the forearm anchor, wherein the forearm anchor is manually adjustable.

* * * * *